US005515930A

United States Patent [19]

Glaser

[11] Patent Number: 5,515,930

[45] Date of Patent: May 14, 1996

[54] HANDHELD PNEUMATIC POWER TOOL APPARATUS

[75] Inventor: Donald J. Glaser, Emporia, Kans.

[73] Assignee: Glendo Corporation, Emporia, Kans.

[21] Appl. No.: 252,596

[22] Filed: Jun. 1, 1994

[51] Int. Cl.[6] ..... B25D 9/14

[52] U.S. Cl. ..... 173/115; 173/128; 173/200; 137/505.12; 137/505.14

[58] Field of Search ..... 173/206, 207, 173/210, 211, 200, 201, 128, 114, 132, 115; 30/164.9; 91/330, 335; 137/505.14, 505.12; 251/295

[56] References Cited

PUBLICATIONS

Air Graver; Instructions; Danville Engineering, Inc. (Date of publication unknown).

*Primary Examiner*—Scott A. Smith

*Assistant Examiner*—Jay A. Stelacone

*Attorney, Agent, or Firm*—Hovey, Williams, Timmons & Collins

[57] ABSTRACT

A handheld pneumatic power tool apparatus is provided for use with a supply of pressurized air. The apparatus includes a handpiece and a pressure regulator assembly for regulating the pressure of air supplied to the handpiece. The handpiece includes a cylinder having first and second ends, an anvil positioned at the first end of the cylinder, and a piston received in the cylinder for bi-directional oscillating movement between the ends. The pressure regulator assembly includes a valve for controlling air flow to the handpiece, a pressure sensing element for sensing the pressure of the air supplied to the handpiece and for automatically controlling the valve in response to the sensed pressure, a compression spring for biasing the pressure sensing element against the pressure of the air supplied to the handpiece, and a foot pedal operatively connected to the compression spring for adjusting the force exerted by the spring on the pressure sensing element in order to adjust the regulated pressure of the supplied air.

6 Claims, 2 Drawing Sheets

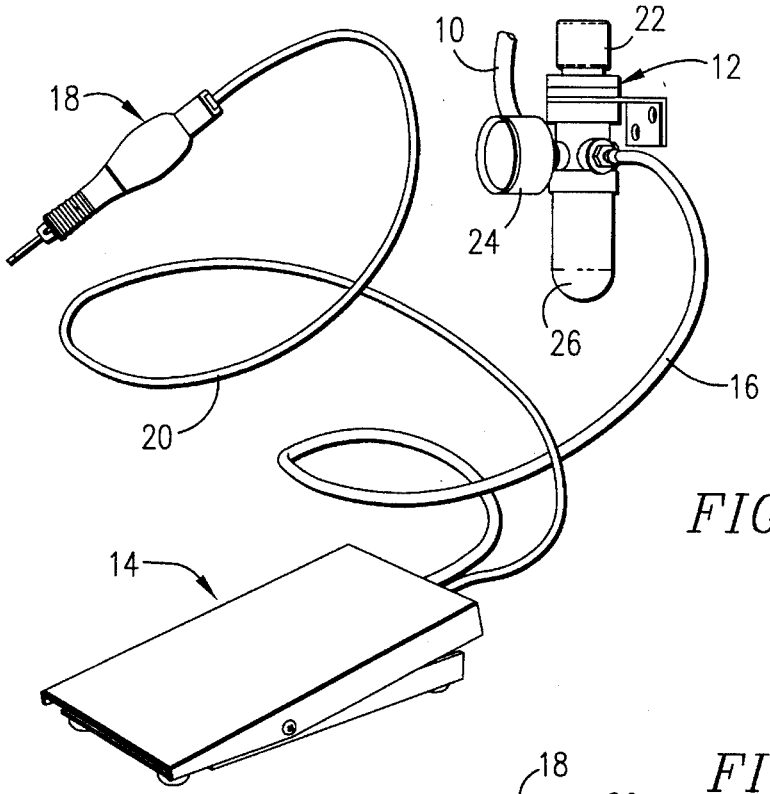
FIG. 1.
FIG. 5.
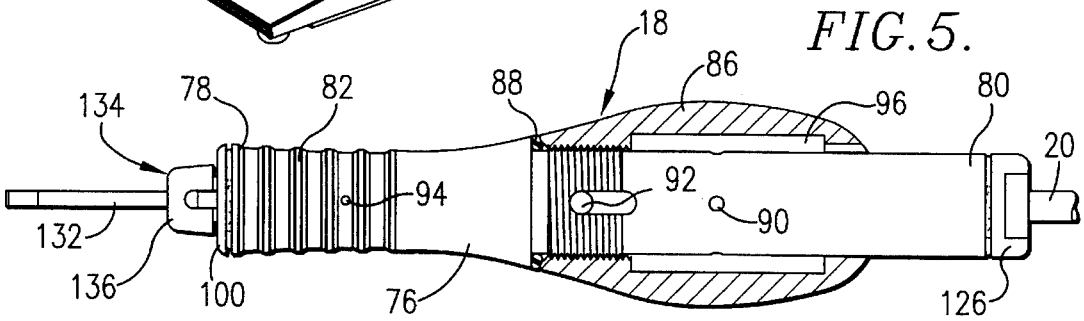
FIG. 6.
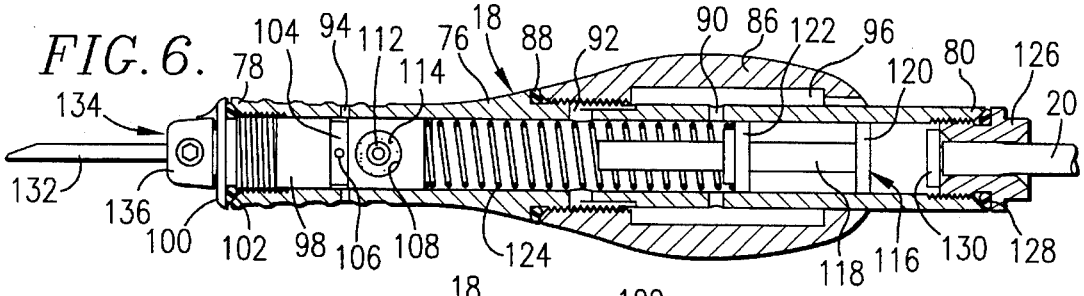
FIG. 7.
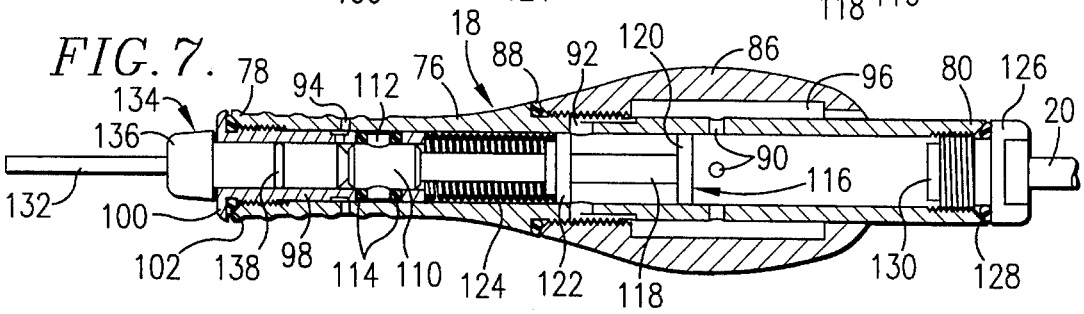

HANDHELD PNEUMATIC POWER TOOL APPARATUS

BACKGROUND OF THE INVENTION

1. Field of the Invention

The present invention relates generally to handheld pneumatic power tools, and more particularly to a handheld tool having a foot-controlled pressure regulator for controlling power to the tool.

2. Discussion of the Prior Art

It is known to provide a handheld pneumatic power tool including a handpiece having a cylinder within which a piston is provided, wherein pressurized air is supplied to the handpiece to oscillate the piston back and forth into and out of engagement with an engraving tool tip.

In this known construction, the means for oscillating the piston within the cylinder includes an air inlet for introducing pressurized air to an end of the cylinder remote from the tool tip, and a compression spring between the piston and the tool tip for biasing the piston against the pneumatic pressure. Exhaust ports communicate with the cylinder at a position intermediate the ends thereof and permit air to be exhausted from the cylinder when the piston is adjacent the tool tip. Thus, pneumatic pressure overcomes the spring to drive the piston in a first direction against the tool tip, and as air is exhausted from the cylinder, the spring biases the piston back away from the tool tip in a second direction.

Control of the handpiece is achieved by controlling the pressure of air supplied to the handpiece. In the conventional construction, this control is obtained by providing a pressure regulator between the air supply and the tool, and a foot-controlled pinch valve. The pressure regulator is normally mounted between the air supply and the pinch valve, and includes a hand-operated knob for adjusting the regulated pressure of the air supplied to the pinch valve.

In this conventional construction, the foot-controlled pinch valve restricts a passage through which air is supplied to the handpiece. Thus, to a certain extent, it is possible to manually control the size of the passage in order to control the amount of air supplied to the handpiece.

In the conventional construction, a certain minimum pressure must be supplied to the handpiece to initiate oscillation of the piston against the bias of the spring. However, this minimum start-up pressure is greater than the minimum pressure needed to maintain oscillation of the piston subsequent to start-up. In order to operate the handpiece at any given pressure below the minimum start-up pressure, it is necessary to supply a higher pressure than desired in order to start the piston oscillating, and to then back off the pressure to the desired level. Alternately, the user can shake the handpiece while supplying the desired level of pressure in the hope that the shaking motion and pressure together will initiate oscillation of the piston.

A problem encountered during use of the conventional construction is that it is often desirable to initiate oscillation of the piston with the tool tip placed against the work piece. For example, when doing intricate engraving work, the tip must be positioned on the work piece before being energized. Otherwise, it is difficult for the user to make the engraving at the desired location on the work piece. In order to obtain the desired control of air to the handpiece, it is necessary for a user of the conventional system to repeatedly adjust the hand-operated pressure regulator and to fiddle with the position of the on/off valve. This represents an inconvenience since the user must remove a hand from the work piece in order to control pressure to the handpiece.

OBJECTS AND SUMMARY OF THE INVENTION

It is an object of the present invention to provide a handheld pneumatic power tool that is easy to use, and may be controlled by a foot-operated pressure regulator that automatically senses pressure variations in an air supply and regulates the pressure of air delivered to the handpiece.

It is another object of the present invention to provide a tool having a piston that oscillates to provide a driving force to a tool tip, and a pressure regulating means that is capable of introducing a surge of air at start-up in order to initiate oscillation of the piston, and thereafter regulates the pressure of air delivered to the handpiece.

In accordance with these and other objects evident from the following description of a preferred embodiment of the invention, a handheld pneumatic power tool apparatus is provided for use with a supply of pressurized air. The apparatus comprises a handpiece and a pressure regulating means for regulating the pressure of air supplied to the handpiece.

The handpiece includes a cylinder having first and second ends, an anvil positioned at the first end of the cylinder, a piston received in the cylinder for bi-directional movement between the ends, and a pneumatic oscillating means for oscillating the piston back and forth within the cylinder into and out of engagement with the anvil.

The pressure regulating means includes a valve for controlling air flow to the handpiece, a pressure sensing element for sensing the pressure of the air supplied to the handpiece and for automatically controlling the valve to regulate the pressure of the supplied air, a biasing means for biasing the pressure sensing element against the pressure of the supplied air, and a foot pedal operatively connected to the biasing means for adjusting the force exerted by the biasing means on the pressure sensing element in order to adjust the regulated pressure of the supplied air.

By providing a power tool in accordance with the present invention, numerous advantages are obtained. For example, by providing a pressure regulating means with a foot pedal for controlling the regulated pressure of air to be delivered to the handpiece, accurate, hands-free control of the handpiece is obtained. In addition, start-up of the handpiece is simplified so that it is not necessary to shake the handpiece or to deliver air to the handpiece at a higher pressure than is desired.

BRIEF DESCRIPTION OF THE DRAWING FIGURES

A preferred embodiment of the present invention is described in detail below with reference to the attached drawing figures, wherein:

FIG. 1 is a perspective view of a handheld pneumatic power tool apparatus constructed in accordance with the preferred embodiment;

FIG. 5 is side elevational view of a handpiece forming a part of the apparatus;

FIG. 6 is a sectional view of the handpiece, illustrating a piston of the handpiece in a first position; and FIG. 7 is a sectional view of the handpiece, illustrating the piston in a second position.

DETAILED DESCRIPTION OF THE PREFERRED EMBODIMENT

Figure 2:
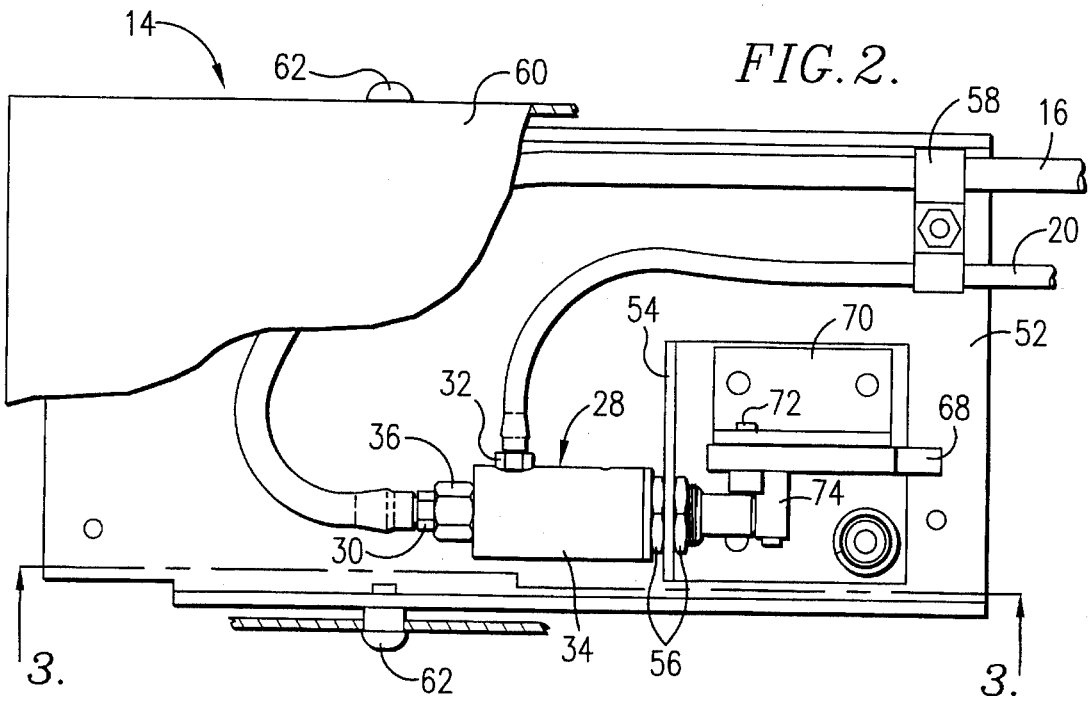
FIG. 2 is a top plan view, partially cut away, of a pressure regulator assembly forming a part of the apparatus.

A handheld pneumatic power tool apparatus constructed in accordance with the preferred embodiment is illustrated in FIG. 1. The apparatus broadly includes an air supply line 10, a hand-operated pressure regulator assembly 12, a foot-operated pressure regulator assembly 14, a distribution line 16 extending between the two regulators, a handpiece 18, and a delivery line 20 extending between the foot-operated pressure regulator and the handpiece.

The air supply line 10 preferably connects the hand-operated regulator assembly 12 to a source of pressurized air, such as a conventional air compressor or the like. The regulator assembly includes an inlet connected to the supply line 10, an outlet connected to the distribution line 16, and a valve for controlling air flow between the inlet and the outlet. In addition, the regulator assembly 12 includes a pressure sensing element for sensing the pressure of the air distributed from the regulator and for controlling the valve to limit the pressure of the distributed air.

A hand-operated knob 22 is connected to the pressure sensing element for adjusting the regulated pressure distributed by the regulator, and adjustment of the regulated pressure is achieved by rotating the knob. A gauge 24 is also provided on the regulator for permitting a user to monitor the pressure of air being distributed, as is a filter 26 for cleaning the air as it passes through the regulator.

Figure 4:
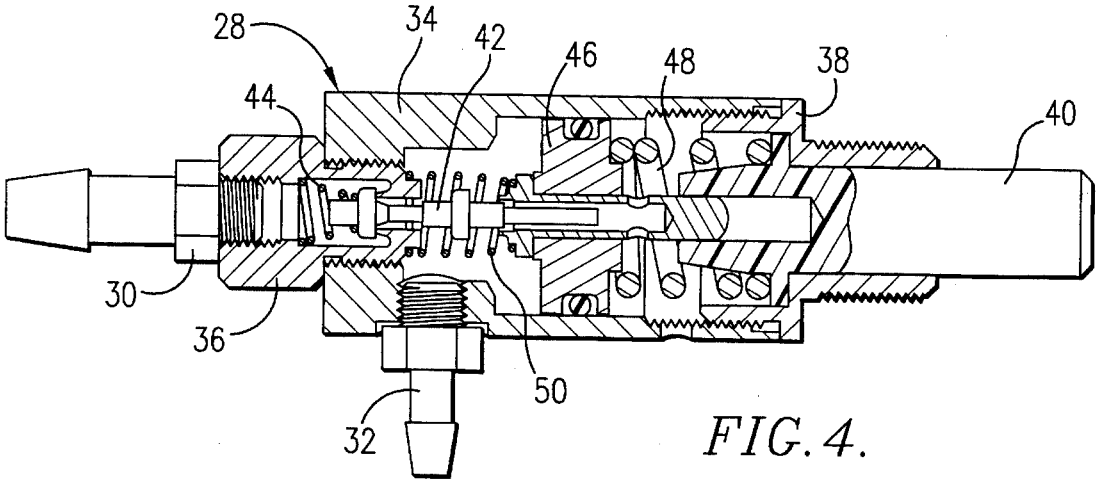
FIG. 4 is a sectional view of a pressure regulator employed in the apparatus.

The foot-controlled pressure regulator assembly 14 is illustrated in FIG. 2, and includes a linearly-actuated regulator 28 of conventional construction, having an inlet 30 connected to the distribution line 16 and an outlet 32 connected to the delivery line 20. The regulator is illustrated in more detail in FIG. 4, and includes an elongated tubular body 34 closed off at one end by a plug 36 defining the inlet and at the other end by a plug 38 within which a linearly movable actuator 40 is received. A valve 42 is provided within the body, and is movable between a closed position as shown, and an open position permitting communication between the inlet and the outlet. A compression spring 44 biases the valve toward the closed position.

A pressure sensing element 46 is also provided within the body, and is movable toward and away from the inlet. The pressure sensing element is exposed to the air passing from the inlet to the outlet, and thus senses the outlet pressure. A compression spring 48 is positioned within the body between the pressure sensing element and the actuator, and biases the pressure sensing element toward engagement with the valve. When the actuator 40 is depressed, i.e. moved from right to left in FIG. 4, the actuator compresses the spring 48, increasing the force acting on the pressure sensing element 46. A smaller compression spring 50 opposes the spring 48 and biases the pressure sensing element away from the valve, and permits the valve to close when the actuator is not depressed.

During operation of the regulator 28, the actuator 40 is depressed, biasing the pressure sensing element 46 against the valve 42 to open it. Because the outlet pressure is ambient prior to opening of the valve, nothing other than the springs 44, 50 impedes movement of the pressure sensing element and valve to the open position. Thus, the valve opens completely, allowing a surge of air to pass through the outlet to the handpiece to initiate operation thereof. As back pressure builds in the delivery line and outlet, this pressure opposes the force of the spring 48, urging the pressure sensing element away from the valve and allowing the valve to move back toward the closed position until an outlet pressure is obtained which balances the force exerted by the spring.

The regulator 28 preferably includes a means for venting any back pressure from the delivery line when the actuator is released. Preferably, this means includes a passageway communicating with the outlet through the pressure sensing element, and a vent opening in the body. This passageway is uncovered when the actuator is moved completely against the plug 38.

Returning to FIG. 2, the pressure regulator 28 is supported on a base 52 by a mounting bracket 54 connected between the base and the plug 38. Preferably, the plug 38 is externally threaded, and is secured to the mounting bracket by nuts 56. The distribution line 16 is connected to the inlet 30 and retained on the base by a clip 58. The delivery line 20 is connected to the outlet 32, and is also retained on the base by the clip 58.

Figure 3:
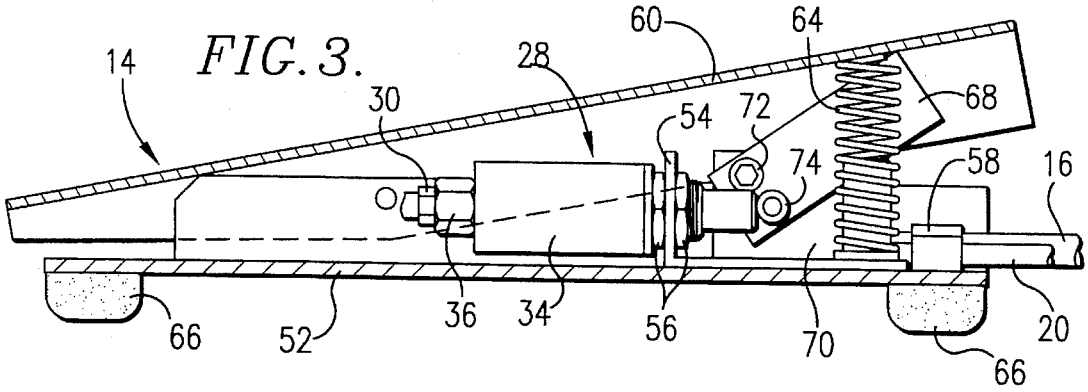
FIG. 3 is a sectional view taken along line 3—3 of FIG. 2.

A foot pedal 60 is supported on the base 52 by a pair of pins 62 and may be pivoted about the pins between a raised position, as shown in FIG. 3, and a lowered or depressed position. A compression spring 64 is provided between the base 52 and the pedal 60 for biasing the pedal toward the raised position. Pads 66 may also be provided on the base for supporting the base on the ground.

A transmission means is provided for transmitting pivotal movement of the pedal 60 to linear movement of the actuator 40 so that when the pedal is depressed the actuator is also. The transmission means includes an arm 68 mounted on a support plate 70 for pivotal movement about a horizontally extending pin 72. A roller or pin 74 extends from the arm 68 in a direction parallel to the pin 72, and engages the free end of the actuator 40. The actuator maintains the arm 68 in a raised position in contact with the pedal, and when the pedal is depressed, it forces the arm to pivot in a clockwise direction, as viewed in FIG. 3, moving the pin 74 against the actuator to depress it.

The handpiece 18 is illustrated in FIG. 5, and includes a tubular body 76 defining a cylinder and having first and second axial ends 78, 80. The body is provided with a number of circumferencial ridges 82 adjacent the first end thereof by which the handpiece may be gripped by a user, and is externally threaded to receive a knob 86 shaped for receipt within the palm of a user's hand. On O-ring seal 88 is provided between the knob and body to hold the knob in place upon assembly.

The body 76 includes three sets of radially extending ports 90, 92, 94. The first and second sets 90, 92 provide communication between the cylinder and the area exterior of the body. The knob overlies these sets of ports, and includes a passageway 96 through which air from the cylinder may be exhausted from the handpiece. If desired, a layer of felt material or the like may be provided in the passageway for muffling the exhaust. The third set of ports 94 is provided adjacent the first end of the body. This set preferably includes four ports.

Turning to FIG. 6, a receiver 98 is provided in the first end 78 of the body, and is externally threaded for engagement with internal threads provided on the body. The receiver 98 is tubular in shape and presents a flange 100 which abuts the first end of the body when the receiver is secured in place. An O-ring seal 102 is positioned between the flange and the first end of the body, and holds the receiver in place upon assembly. The outer surface of the receiver includes a circumferencial groove 104, and a port 106 extends through the wall of the receiver within the groove. The port 106 allows communication between the interior of the receiver and the area exterior of the handpiece via the groove 104 and the third set of ports 94 in the body.

A pair of diametrically opposed, transverse holes 108 are formed in the receiver adjacent an end of the receiver opposite the flange 100. As shown in FIG. 7, an anvil 110 is supported within the receiver by a transverse pin 112 extending through the holes 108. The pin 112 is supported within the holes by a pair of resilient O-rings 114 so that the anvil and pin may move within a limited range of movement relative to the receiver.

A piston 116 is received in the cylinder for bi-directional movement between a first position out of engagement with the anvil, as shown in FIG. 6, and a second position engaging the anvil. The piston includes a central rod 118 having a piston head 120 formed at one end and a spring seat 122 provided intermediate the ends. A compression spring 124 is positioned within the body and seats against the spring seat 122 and the receiver 98, and biases the piston 116 away from the anvil 110. The second end 80 of the body 76 is normally closed off by an end cap 126 that is externally threaded to mate with internal threads provided within the second end of the body. An O-ring seal 128 is provided between the cap and the body to hold the cap in place upon assembly. The cap 126 includes an axial passage adapted to receive the delivery line 20, and a hose retainer 130 is provided for securing the line to the cap.

As shown in FIG. 7, a tool tip 132 is supported within the receiver by a tool holder 134 within which the tip is secured, e.g. by a set screw or the like. The tool holder includes a flange 136 adapted to engage the receiver when the holder is manually pushed into the receiver during assembly. The holder includes a circumferencial groove within which a resilient O-ring 138 is provided. The O-ring provides a friction fit between the holder and the receiver so that it is possible to install or remove the holder from the handpiece by simply pushing or pulling on the holder.

During operation, air is supplied to the body cylinder through the cap 126 at the second end 80 of the body, and forces the piston 116 toward the anvil 110, as shown in FIG. 7. During travel of the piston toward the anvil, air within the cylinder between the piston and the anvil is exhausted through the second set of ports 92. Preferably this set includes two ports.

As the piston 116 approaches the anvil, the four ports forming the first set 90 are exposed to the second end of the cylinder by the piston, permitting air within the second end of the cylinder to be exhausted. However, the momentum of the piston is sufficient to carry the piston into contact with the anvil, impacting the anvil with a force that is transmitted to the tool tip.

As air is exhausted from the second end of the cylinder, and as the momentum of the piston is transferred to the anvil, the spring 124 forces the piston back away from the anvil. This movement of the piston blocks the first set of ports 90 from the second end of the cylinder, allowing the air pressure to again force the piston back against the anvil. Thus, a repetitive oscillation of the piston is obtained.

In order to control the power of the handpiece, the operator adjusts the position of the foot pedal 60, altering the regulated pressure of air supplied to the handpiece. Because the foot pedal is capable of being moved between an infinite number of positions, the range of adjustment extends from zero to the pressure of the air at the inlet of the regulator. Thus, if the hand-operated regulator assembly 12 is set to distribute air to the regulator assembly 14 at a pressure of 60 lbs., the foot-operated regulator assembly 14 can provide a range of regulated pressures between about 0–60 lbs. In this manner, it is possible to set an upper limit on the power of the handpiece by setting the hand-operated regulator assembly 12, and the foot-operated regulator assembly 14 may be used to control the pressure at values below the upper limit.

Although the invention has been described with reference to the preferred embodiment illustrated in the attached drawing figures, it is noted that substitutions may be made and equivalents employed herein without departing from the scope of the invention as set forth in the claims.

What is claimed is:

1. A handheld pneumatic power tool apparatus for use with a supply of pressurized air, the apparatus comprising:

a handpiece including a cylinder having first and second ends, an anvil positioned at the first end of the cylinder, a piston received in the cylinder for bi-directional movement between the ends, and a pneumatic oscillating means for oscillating the piston back and forth within the cylinder into and out of engagement with the anvil, the pneumatic oscillating means including an air inlet for introducing pressurized air to the cylinder to bias the piston toward one of the ends of the cylinder, an exhaust means for exhausting air from the cylinder after the air has moved the piston toward the one end, and a piston biasing means for biasing the piston away from the one end such that the piston is moved away from the one end as air is exhausted from the cylinder; and a pressure regulating means connected between the supply of pressurized air and the handpiece for regulating the pressure of air supplied to the handpiece, the pressure regulating means including a valve for controlling air flow to the handpiece, a pressure sensing element for sensing the pressure of the air supplied to the handpiece and for automatically controlling the valve to regulate the pressure of the supplied air, an element biasing means for biasing the pressure sensing element against the pressure of the supplied air, and a foot pedal operatively connected to the element biasing means for adjusting the force exerted by the element biasing means on the pressure sensing element in order to adjust the regulated pressure of the supplied air.

2. An apparatus as recited in claim 1, wherein the pressure regulating means includes a base on which the foot pedal is mounted for pivotal movement about a horizontal axis, a pedal biasing means for biasing the pedal toward an off position in which the regulated pressure is zero, and an intermediate transmission means for transmitting pivotal movement of the pedal to the element biasing means.

3. An apparatus as recited in claim 2, wherein the pressure regulating means includes a means for venting the pressure of the air supplied to the handpiece when the pedal is in the off position.

4. An apparatus as recited in claim 2, wherein the transmission means includes a linear actuator for adjusting the position of the first biasing means relative to the valve, and a transmission member supported on the base for pivotal movement, the transmission member being interposed between the pedal and the actuator.

5. An apparatus as recited in claim 1, wherein the pedal is movable between an off position in which the regulated pressure is zero and a number of on positions in which the regulated pressure ranges from zero to the pressure of the supply of pressurized air, the apparatus further comprising a pressure regulator for regulating the pressure of air supplied to the pressure regulating means so that the pressure of air supplied to the handpiece may be controlled.

6. An apparatus as recited in claim 5, wherein the pressure regulator includes a means for filtering the supply of pressurized air.

* * * * *